US008864286B2

(12) United States Patent
Mizutani

(10) Patent No.: US 8,864,286 B2
(45) Date of Patent: Oct. 21, 2014

(54) LIQUID EJECTING HEAD

(71) Applicant: Canon Kabushiki Kaisha, Tokyo (JP)

(72) Inventor: Michinari Mizutani, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/860,828

(22) Filed: Apr. 11, 2013

(65) Prior Publication Data

US 2013/0278678 A1 Oct. 24, 2013

(30) Foreign Application Priority Data

Apr. 18, 2012 (JP) ..... 2012-094800

(51) Int. Cl.
*B41J 2/14* (2006.01)

(52) U.S. Cl.
CPC ..... *B41J 2/1433* (2013.01); *B41J 2002/14387* (2013.01); *B41J 2/1404* (2013.01); *B41J 2002/14475* (2013.01)
USPC ..... 347/47

(58) Field of Classification Search
CPC ..... B41J 2/1433; B41J 2/1603; B41J 2/1631; B41J 2/1404
USPC ..... 347/20, 45, 47, 54
See application file for complete search history.

(56) References Cited

U.S. PATENT DOCUMENTS

| | | | |
|---|---|---|---|
| 6,280,020 | B1 | 8/2001 | Tachihara et al. |
| 6,286,933 | B1 | 9/2001 | Murakami et al. |
| 6,325,493 | B1 | 12/2001 | Yamaguchi |
| 6,652,062 | B2 | 11/2003 | Umeyama et al. |
| 6,824,243 | B2 | 11/2004 | Yamaguchi et al. |
| 7,070,267 | B2 | 7/2006 | Yamaguchi et al. |
| 7,585,616 | B2 | 9/2009 | Shaarawi et al. |
| 2003/0048328 | A1 | 3/2003 | Inamoto et al. |

FOREIGN PATENT DOCUMENTS

| | | | |
|---|---|---|---|
| JP | 11-138817 | A | 5/1999 |
| JP | 2003-80717 | A | 3/2003 |

*Primary Examiner* — An Do

(74) *Attorney, Agent, or Firm* — Fitzpatrick, Cella, Harper & Scinto

(57) ABSTRACT

A liquid ejecting head includes: an orifice plate provided with an ejection port forming face which has an ejection port row formed thereon, the ejection port row including a plurality of ejection ports which eject a liquid arrayed in a first direction, wherein each of the ejection ports is formed inside a plurality of grooves which are provided on the ejection port forming face and extend in a second direction that intersects with the first direction, and with respect to a cross section of the groove in the first direction, which includes centers of the ejection ports, the groove has an inner wall surface in a circular arc shape, and the groove has an aperture larger than an aperture of the ejection port, in the first direction.

12 Claims, 10 Drawing Sheets

LIQUID EJECTING HEAD

BACKGROUND OF THE INVENTION

1. Field of the Invention

The present invention relates to a liquid ejecting head which ejects a liquid such as ink from an ejection port.

2. Description of the Related Art

A recording apparatus provided with a liquid ejecting head can output characters and images of high quality at low cost. Nowadays it is desired to reduce the size of a droplet for enhancing an image quality, and it is known that a slight variation of the dimension of a nozzle gives influence on ejection and consequently gives influence on the image quality. While such a high image quality is required as described above, in a conventional method of bonding an orifice plate onto a silicon substrate, dimensional tolerances for the warpage in the upper and lower sides and front and back sides of an orifice plate, lack of bonding precision occasionally, and the like may give influence on ejection stability and ejection quantity. In order to achieve reduction in the size of the droplet and stable ejection for the further enhancement of the image quality, a resin lamination on a silicon substrate has become a mainstream as a method of producing the nozzle.

In the liquid ejecting head, a refilling period of time until the pressure chamber is filled again with ink after a predetermined amount of ink has been ejected from the pressure chamber (i.e. easiness of refilling) is dependent on physical properties of the ink and a structure of an ink flow channel. For instance, because a high viscosity ink has a high flow resistance in a region including a pressure chamber, the refilling period of time tends to be relatively long. In addition, when the sectional area of the ink flow channel is small, the flow resistance becomes large from a common liquid chamber to a pressure chamber, and accordingly the refilling period of time also becomes relatively long. The frequency (ejection frequency) with which one nozzle repeats ejection is required to have a longer cycle time than the refilling period of time which is determined by the physical properties of the ink and the structure of the ink flow channel.

On the other hand, when the refilling period of time is shorter than necessary compared to the cycle of ejection frequency, and flow resistance is small, a tip part (meniscus) of the ink in the ink channel occasionally overshoots when the ink has been refilled, and the ink occasionally overflows from the periphery of the ejection port. As has been described above, the ejection frequency in a recording element is required to be set at a short cycle of such a degree as not to cause overshooting.

In other words, the upper limit of the refilling frequency to be actually used is determined according to the physical properties of the ink and the structure of the ink flow channel, and it is desirable that the refilling frequency is set so as not to exceed this range.

However, when a carriage speed of an ink-jet printer is increased in an attempt to achieve further enhancement of the speed of the liquid ejecting head, another problem occurs which has not been considered up to now.

Specifically, as the carriage speed is increased, the refilling frequency of a head must necessarily be increased. As has been described above, in a head having high refilling frequency, the meniscus of ink overshoots when the ink is refilled, and the ink tends to easily overflow from the periphery of the ejection port.

Furthermore, when images are continuously recorded at high frequency, at a high printing speed, and with high duty for a long period of time, a large quantity of ink mist is produced, and an ink droplet gradually becomes stagnant on the face of the ejection port, which causes the ink to easily overflow from the ejection port. Still furthermore, when the water repellency of an ejection port forming face of a print head is lowered or the ejection port forming face is hydrophilic, ink tends to more remarkably overflow from the periphery of the ejection port due to the overshooting of the meniscus of the tip part of the ink when the ink has been refilled.

As a method of reducing an ink which overflows from the periphery of the ejection port, a multi-pass recording method is widely known, which reduces an effective frequency of the nozzle of the recording head. However, in the multi-pass recording method, when the carriage frequency is increased, the number of scanning times for recording prints increases, which accordingly results in a harmful effect on high-speed printing.

Specification of U.S. Pat. No. 7,585,616 discloses a nozzle having a recess part formed in an ejection port portion, as a nozzle effective in reducing the stagnation of an ink droplet on the face of the ejection port.

However, in the nozzle having the recess part formed on the face of the ejection port as is disclosed in the specification of U.S. Pat. No. 7,585,616, the ink droplet stagnates in the recess part instead of on the face of the ejection port. Furthermore, in the above described head having high refilling frequency, the meniscus at the tip part of the ink may disadvantageously overshoot when the ink has been refilled and the ink overflows from the recess part. The overflowed ink reaches even a neighboring nozzle and causes an ejection kink of the neighboring nozzle.

SUMMARY OF THE INVENTION

According to an aspect of the present invention, there is provided a liquid ejecting head that includes: an orifice plate provided with an ejection port forming face which has an ejection port row formed thereon, the ejection port row including a plurality of ejection ports which eject a liquid arrayed in a first direction, wherein the ejection ports are each formed inside a plurality of grooves which are provided on the ejection port forming face and extend in a second direction that intersects with the first direction, and with respect to a cross section of the grooves in the first direction, which includes centers of the ejection ports, the grooves each have an inner wall surface in a circular arc shape, and the grooves have an aperture larger than an aperture of the ejection ports, in the first direction.

According to another aspect of the present invention, there is provided a liquid ejecting head that includes: an orifice plate provided with an ejection port forming face which has an ejection port row formed thereon, the ejection port row including a plurality of ejection ports which eject a liquid arrayed in a first direction, wherein the ejection ports are each formed inside a plurality of grooves which are provided on the ejection port forming face and extend in a second direction that intersects with the first direction, and with respect to a cross section of the grooves in the first direction, which includes centers of the ejection ports, the grooves each have an inner wall surface of an inclined plane, and the grooves each have an aperture larger than an aperture of the ejection port, in the first direction.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Embodiments of the present invention will be described below with reference to the drawings. Each of dimensions, numeric values and the like which have been shown in the following embodiments simply shows an example, and the present invention is not limited by the examples. In addition, the liquid ejecting head which will be described below in the following embodiments is represented by an ink jet recording head which ejects an ink and records an image, but is not limited to this ink jet recording head, and can be applied to general liquid ejecting heads which eject a liquid from an ejection port.

Figure 1:
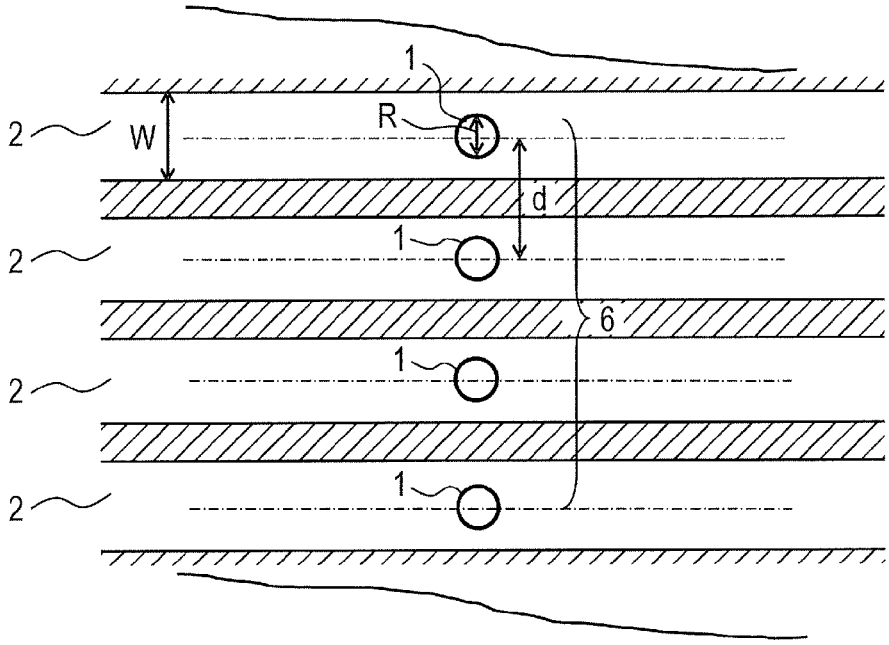
FIG. 1 is a schematic view of a recording head according to a first embodiment.
Figure 2:
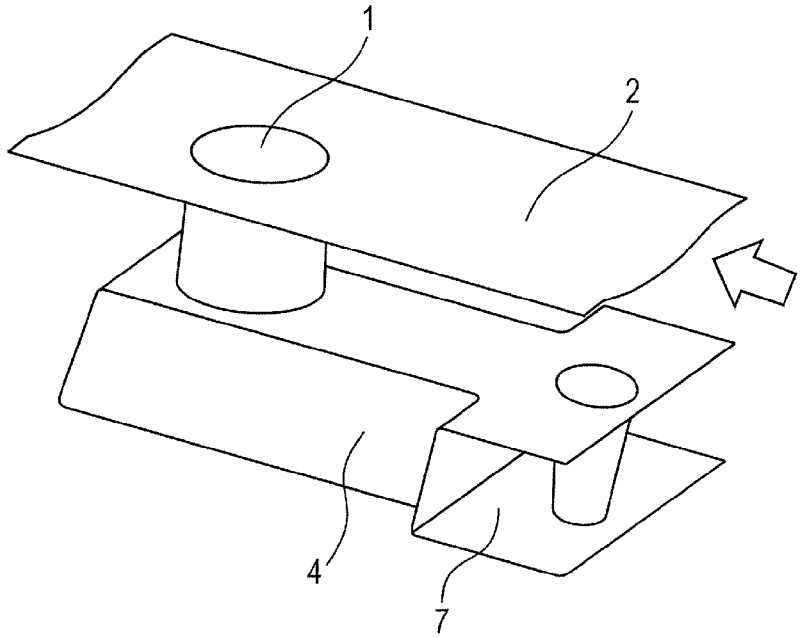
FIG. 2 is a perspective view of an appearance of a nozzle of the recording head according to the first embodiment.

FIG. 1 is a schematic view for describing a part of a structure of a recording element row in a liquid ejecting head according to the present embodiment. In addition, FIG. 2 is a perspective view of an appearance of the recording head. An ink that has been supplied to a common liquid chamber 7 from a supply port which is formed on a not-shown substrate so as to supply the ink is branched into a plurality of ink flow channels extending in one row and reaches a pressure chamber provided on a tip of the respective ink flow channels. An electrothermal conversion element provided on the substrate (wafer) formed from silicon in the pressure chamber rapidly generates heat by a voltage pulse which has been applied to the electrothermal conversion element according to a recording signal. This heat generation causes foaming, due to film boiling, in the ink present in a region from the ink flow channel to the pressure chamber, and a predetermined amount of ink droplet is ejected to the outside of the recording head from the ejection port 1. In the present embodiment, the ejection port is formed in an orifice plate formed of a resin, and the ink flow channel is formed in a bonded face of the substrate and the orifice plate. In the following description, a structure from the ink flow channel to the ejection port will be defined as one nozzle, and a face (face on which ejection port is formed) which exists in a nozzle outlet side of the recording head and opposes a recording medium will be defined as an ejection port forming face. With reference to FIG. 1, 512 ejection ports 1 (ejection port row 6) which are arrayed in one row are arrayed at a pitch (distance d) of 1/600 inches. In other words, the recording head ejects the ink while scanning in a main scanning direction, and can thereby record 512 dots on the recording medium in a subscanning direction at 600 dpi (dot/inch; reference value). Each of the nozzles in the present embodiment is produced so that a diameter R of an ejection port 1 is 20 μm and a sectional area of the flow channel of the nozzle is set so that a refilling frequency is approximately 40 kHz.

Figure 3:
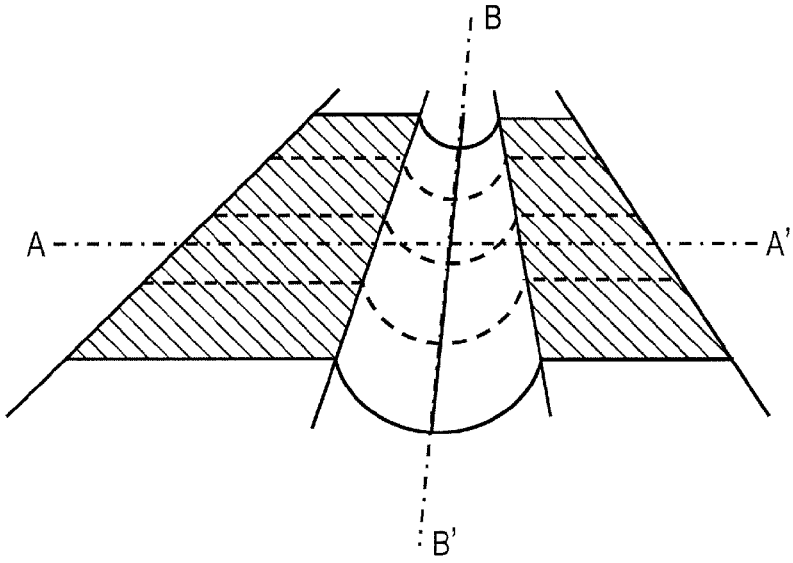
FIG. 3 is an enlarged view of a groove of the recording head according to the first embodiment.
Figure 4A:
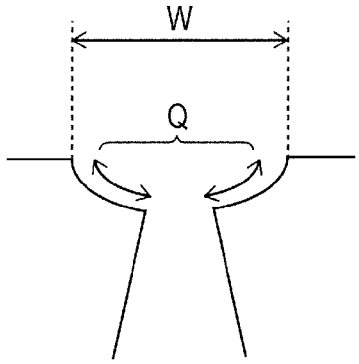
FIG. 4A is a view of a cross section taken along the line A-A' of FIG. 3.
Figure 4B:
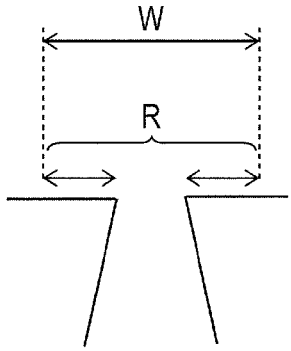
FIG. 4B is a view of a cross section taken along the line B-B' of FIG. 3.

FIG. 1 illustrates a state of an ejection port forming face on the orifice plate, and strip-shaped grooves 2 which are formed so as to be recessed are formed in parallel to each other on the ejection port forming face. A plurality of the grooves 2 are separated by regions of diagonally shaded areas illustrated in FIG. 1, and do not communicate with each other. As is illustrated in FIG. 2, one ejection port 1 is arranged on a bottom face part of each of the grooves 2, and the width of the groove 2 is larger than the diameter of the ejection port 1. An ejection port row 6 extends in a direction which intersects with (which is perpendicular to) an extending direction of the groove 2. FIG. 2 illustrates a perspective view of a nozzle when viewed through a part of the orifice plate, which is supposed to be transparent. In the groove 2, the bottom part is formed into a curved shape, so-called a barrel shape, and the ejection port 1 is formed in the bottom part. In the present embodiment, the shape of the groove forms a tapered shape which tapers from the flow channel down to the ejection port, as is illustrated in the figure, and its tapered angle is set at approximately 5 degrees. However, even when there is no taper of the ejection port, the present invention is not affected by the absence of the taper. FIG. 3 illustrates a shape of the groove 2 when viewed from an arrow portion of FIG. 2 (though ejection port is not shown). FIG. 4A is a view of a cross section taken along the line A-A' of FIG. 3, in other words, a view of a cross section perpendicular to an extending direction of the groove 2 including the central axis of the ejection port row 6, the maximum depth is 2 μm, and the width W is 35 μm. FIG. 4B is a view of a cross section taken along the line B-B' of FIG. 3, in other words, a view of a cross section perpendicular to the ejection port row 6 including the center of the ejection port 1. An average value of a curvature in a portion except the ejection port of the groove in the cross section taken along the line A-A' is larger than an average value of a curvature in a portion except the ejection port of a region which regards the ejection port as the center and has a width equal to the full width of the groove, in the cross section taken along the line B-B'. Here, the average value of the curvature means a value obtained by integrating the curvature over a region (defined as region P) for which an average value is calculated, and dividing the integrated value by the length of the region P. In FIGS. 4A and 4B, a region in the cross section taken along the line A-A', for which the average value of the curvature is calculated, is described as Q, and a region in the cross section taken along the line B-B', for which the average value of the curvature is calculated, is described as R. In FIG. 4B, an inner face (bottom face) of the groove in the cross section taken along the line B-B' is flat, and accordingly the average value of the curvature is zero. In other words, an average curvature of the inner face of the groove in the arrayed direction (first direction) of the ejection ports is different from that in the direction (second direction) which intersects with the first direction.

In addition, as is illustrated in FIG. 4A, with respect to the cross section of the groove including the ejection port in the array direction (first direction) of the ejection ports in the present embodiment, an inner wall of the groove is formed into a circular arc shape. In addition, with respect to the first direction, an aperture of the groove 2 is larger than an aperture of the ejection port 1.

Figure 5A:
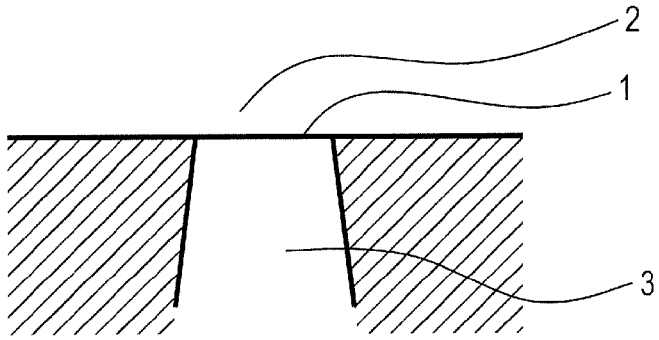
FIGS. 5A, 5B, 5C and 5D are schematic views illustrating states of the ink in time series, which is refilled in the recording head according to the first embodiment.
Figure 5B:
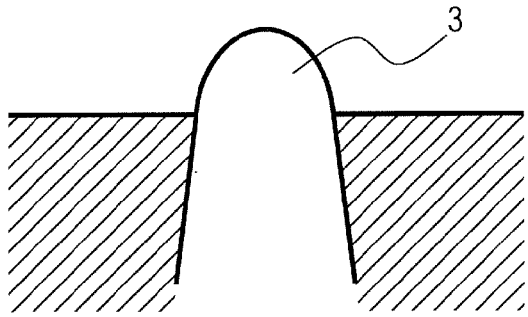
Figure 5C:
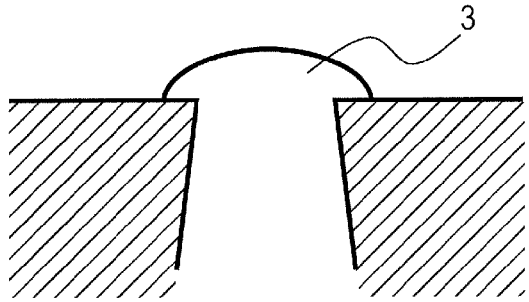
Figure 5D:
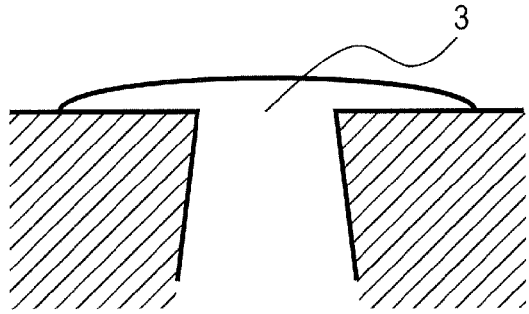

FIGS. 5A, 5B, 5C and 5D are schematic views illustrating a process of refilling the ejection port with an ink 3 after the ink droplet has been ejected from the ejection port, in time series, when the groove 2 is formed into such a barrel shape as to extend in a direction perpendicular to a nozzle row. In these FIGS. 5A to 5D, the ejection port 1, the groove 2 and the ink 3 are each shown. FIG. 5A illustrates a state in which a liquid face of the ink in the ejection port is approximately aligned with an ejection port forming face, and FIG. 5B illustrates a state in which the ejection port is refilled with the ink and the ink overshoots the ejection port to hump to the maximum height. The height of the hump was approximately 8 μm. FIG. 5C illustrates a state in which a certain period of time has further passed after the ink has humped to the maximum height. The ink having humped starts spreading symmetrically along a direction in which the recess part continues. FIG. 5D illustrates a state in which a certain period of time has further passed after the state in FIG. 5C. The ink has completely spread, and the ink does not overflow in such a degree as to climb over the groove 2 having the barrel shape. In the present embodiment, the ejection port is thus formed on the inside of the groove 2, and accordingly even in a head having a high refilling frequency of approximately 40 kHz, the overshooting of the meniscus of the ink is suppressed when the ink is refilled. In addition, even when the ink has overshot the ejection port, the overflow of the ink to the outside of the groove from the groove 2 is suppressed. The liquid ejecting head having the structure of the present Example could stably print characters by 1 pass continuously at high speed, even when the ink jet recording apparatus performed a scan at a driving frequency of 30 kHz and at a carriage speed of 50 inches/second. Incidentally, in all embodiments including the present embodiment, the upper face part of the ejection port 1 and the inside of the groove are not subjected to water repellency treatment and does not become a water repellent state, but may be subjected to water repellency or hydrophilicity treatment. Thus, in the present embodiment, an average curvature of the inner face of the groove in the array direction (first direction) of the ejection ports is different from that in a second direction which intersects with the first direction. Because of the large curvature in the adjacent ejection port side, the overflow of the ink protruding from the ejection port to the outside after the ink has been ejected is suppressed to the adjacent ejection port side. As in the present embodiment, even when the liquid ejecting head has a high driving frequency and the ink relatively largely protrudes after the ejection port has been refilled with the ink, the ink spreads in a direction along the groove, and accordingly the overflow of the ink to the adjacent ejection port side can be suppressed.

Figure 6:
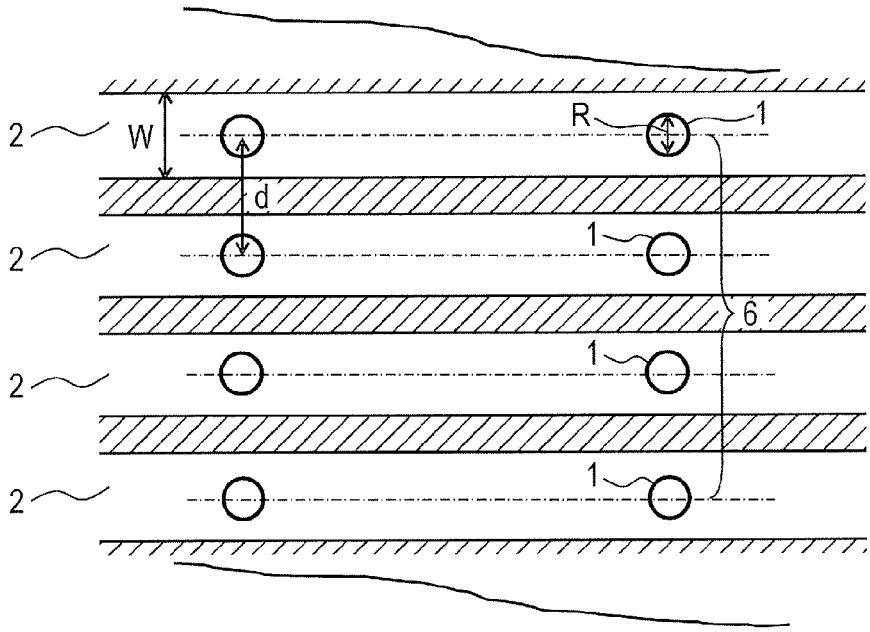
FIG. 6 is a schematic view of a recording head according to a second embodiment.
Figure 7:
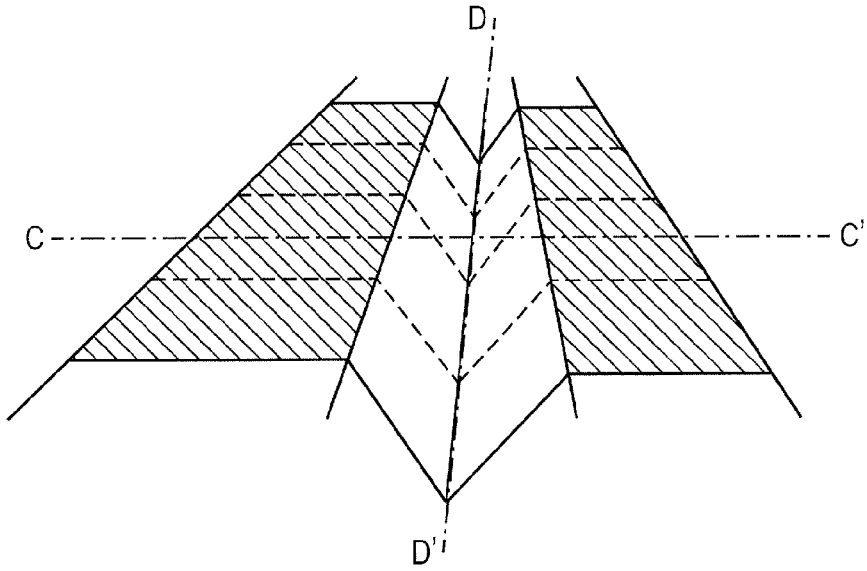
FIG. 7 is an enlarged view of a groove of the recording head according to the second embodiment.
Figure 8A:
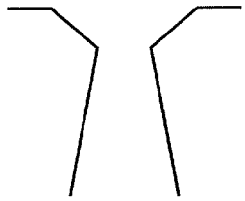
FIG. 8A is a view of a cross section taken along the line C-C' of FIG. 7.
Figure 8B:
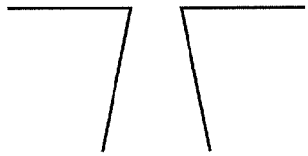
FIG. 8B is a view of a cross section taken along the line D-D' of FIG. 7.

FIG. 6 is a schematic view for describing a part of a structure of a recording element row in a liquid ejecting head according to a second embodiment. Also in the respective nozzles of the present embodiment, a nozzle is structured so that a diameter R of the ejection port 1 is 20 μm, and a refilling frequency is approximately 40 kHz, in a similar way to that in the first embodiment. In FIG. 6, a plurality of grooves 2 are more recessed than diagonally shaded areas, and are formed in parallel. In the second embodiment, two ejection ports 1 are provided on each of the grooves 2, and two ejection port rows 6 (first and second ejection port rows) are formed in a direction perpendicular to an extending direction of the groove 2. FIG. 7 illustrates a perspective view of the groove (though ejection port is not shown). In the present embodiment, the groove has a V-shape, and the two ejection ports 1 are formed in the V-shaped groove, though the ejection ports are not shown. FIG. 8A is a view of a cross section taken along the line C-C' of FIG. 7, in other words, a view of a cross section perpendicular to an extending direction of the groove 2 including the central axis of the ejection port row 6, the maximum depth of the groove is 2 μm, and the width W thereof is 35 μm. FIG. 8B is a view of a cross section taken along the line D-D' of FIG. 7, in other words, a view of a cross section perpendicular to the ejection port row 6 including the center of the ejection port 1.

In addition, as is illustrated in FIG. 8A, with respect to the cross section of the groove including the ejection port in the array direction (first direction) of the ejection ports in the present embodiment, an inner wall surface of the groove is formed into an inclined plane. In addition, with respect to the first direction, an aperture of the groove 2 is larger than an aperture of the ejection port 1.

Also in the present embodiment, the same effect as that in the first embodiment is obtained. Even though the head has a high refilling frequency of approximately 40 kHz, the overshooting of the meniscus of the ink is suppressed when the ink is refilled, and the overflow of the ink from the periphery of the ejection port can be suppressed. The liquid ejecting head could stably print characters by 1 pass continuously at high speed, even when the ink jet recording apparatus performed a scan at a driving frequency of 30 kHz and at a carriage speed of 50 inches/second.

Figure 9:
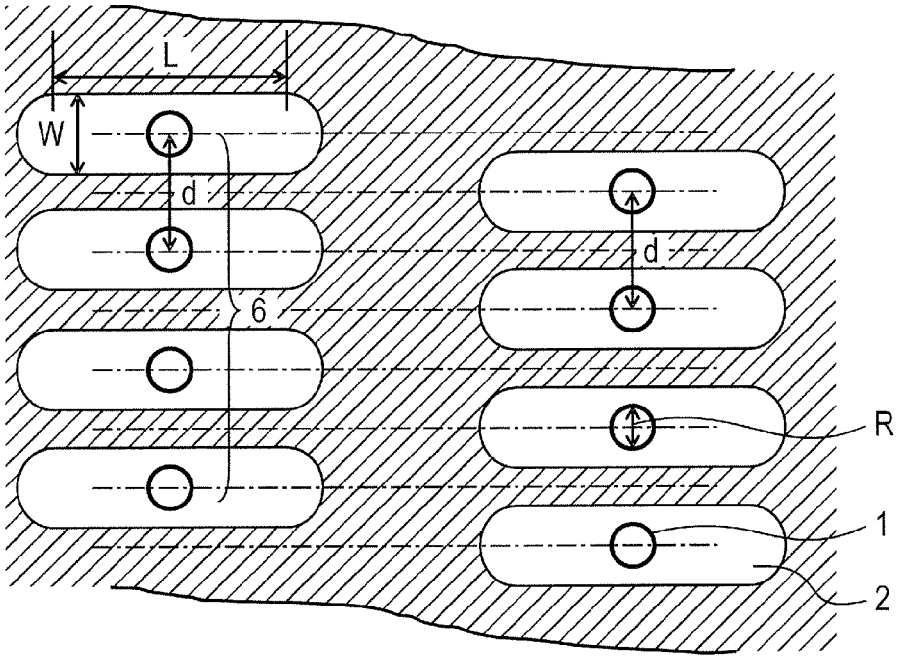
FIG. 9 is a schematic view of a recording head according to a third embodiment.
Figure 10:
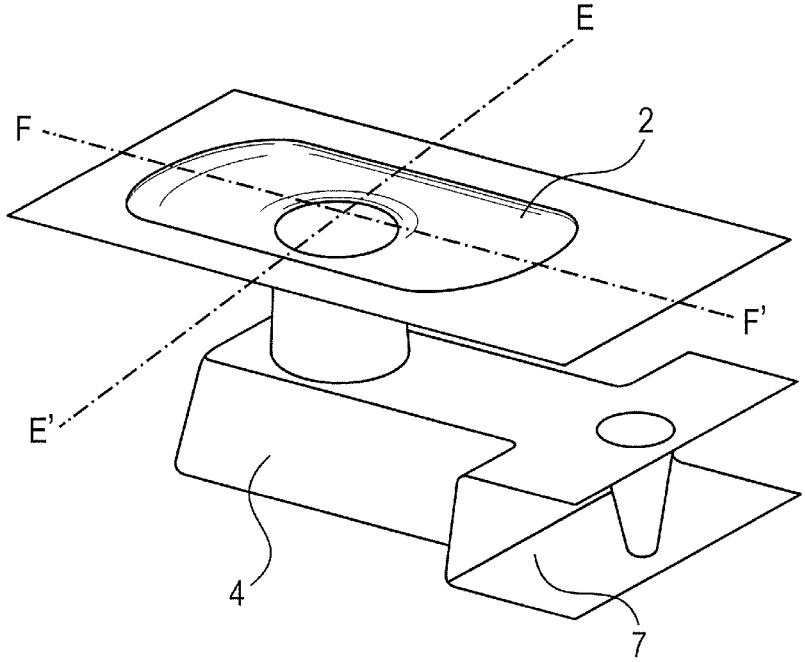
FIG. 10 is a perspective view of an appearance of a nozzle of the recording head according to the third embodiment.

FIG. 9 is a schematic view for describing a part of a structure of a recording element row in a liquid ejecting head according to a third embodiment. In addition, FIG. 10 is a perspective view of an appearance of the recording head. With reference to FIG. 9 and FIG. 10, in a plurality of the ink flow channels 4 extending to right and left with respect to the common liquid chamber 7, 512 ejection ports are arrayed in each row at a pitch d of 1/600 inches, and further, the ejection ports in the right row and the left row are displaced from each other by a half pitch in a vertical direction of the figure. In other words, when the recording head ejects the ink while performing a scan in a main scanning direction, the recording head can thereby record 1,024 dots on the recording medium at 1,200 dpi (dot/inch; reference value) in a subscanning direction.

Each of the nozzles in the present embodiment has such a nozzle shape that a diameter R of the ejection port 1 is 20 μm and a refilling frequency becomes approximately 40 kHz.

The groove 2 in FIG. 9 is formed so as to be recessed into an oval region. One ejection port 1 is provided on each of the grooves 2. The ejection port row 6 is formed in a direction perpendicular to an extending direction of the groove 2.

FIG. 10 illustrates a view of an appearance of a nozzle. The ejection port 1 is formed in the oval-shaped groove 2. In the present embodiment, a tapered angle of approximately 5 degrees is imparted to the ejection port as is illustrated, but even when there is no taper of the ejection port, the present invention is not affected by the absence of the taper.

Figure 11A:
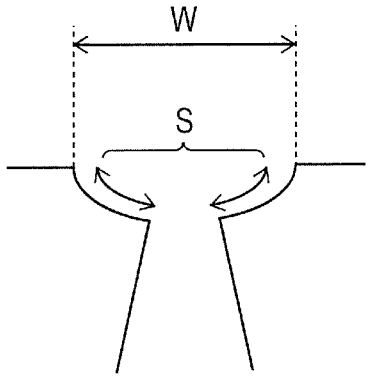
FIG. 11A is a view of a cross section taken along the line E-E' of FIG. 10.
Figure 11B:
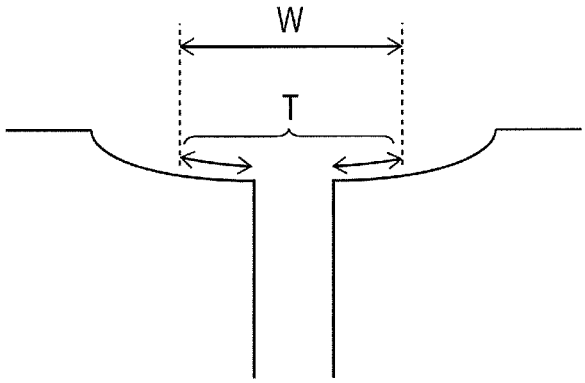
FIG. 11B is a view of a cross section taken along the line F-F' of FIG. 10.

FIG. 11A is a view of a cross section taken along the line E-E' of FIG. 10, in other words, a view of a cross section perpendicular to an extending direction of the groove 2 including the central axis of the ejection port row 6. The maximum depth of the groove is 2 μm and the width W thereof is 35 μm. The length L thereof is desirably longer than the width W, and in the present embodiment, the length L is 35 μm which is the lower limit. FIG. 11B is a view of a cross section taken along the line F-F' of FIG. 10, in other words, a view of a cross section perpendicular to the ejection port row 6 including the center of the ejection port 1. An average value of a curvature in a portion except the ejection port of the groove in the cross section taken along the line E-E' is larger than an average value of a curvature in a portion except the ejection port of the groove in the cross section taken along the line F-F', in a region which regards the ejection port as the center and has a width equal to the full width of the groove. In FIGS. 11A and 11B, a region in the cross section taken along the line E-E", for which the average value of the curvature is calculated, is described as S, and a region in the cross section taken along the line F-F', for which the average value of the curvature is calculated, is described as T.

Figure 12A:
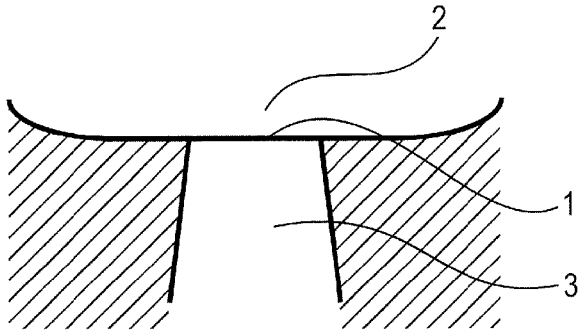
FIGS. 12A, 12B, 12C and 12D are schematic views illustrating states of the ink in time series, which is refilled in the recording head according to the third embodiment.
Figure 12B:
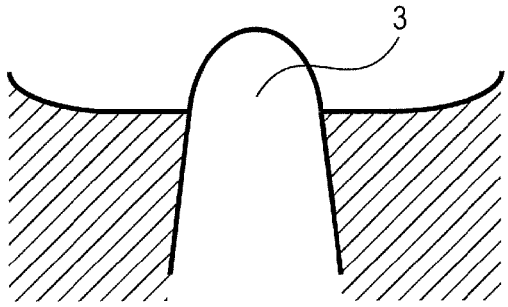
Figure 12C:
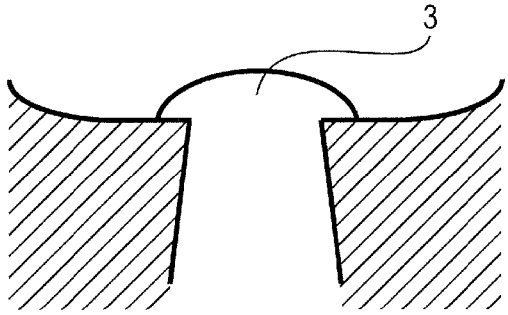
Figure 12D:
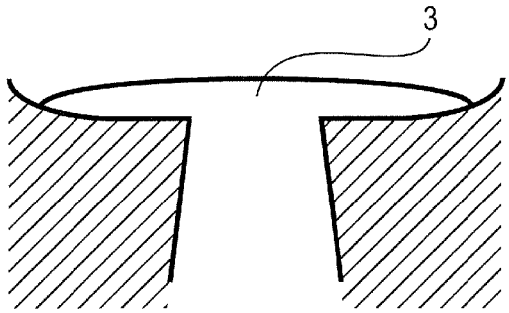

FIGS. 12A, 12B, 12C and 12D are schematic views illustrating a process of refilling the ejection port with an ink after the ink droplet has been ejected, in time series, when the groove is formed into such an oval shape as to extend in a direction perpendicular to the nozzle row. In these FIGS. 12A to 12D, an ejection port 1, a groove 2 and an ink 3 are each shown. FIG. 12A illustrates a state of the time before the ink is ejected, and FIG. 12B illustrates a state in which the ejection port is refilled with an ink after the ink has been ejected, and the ink overshoots the ejection port to hump to the maximum height. The height of the hump was approximately 8 μm. FIG. 12C illustrates a state in which a certain period of time has further passed after the state in which the ink has humped to the maximum height. As is clear from the figure, the ink starts spreading symmetrically along a longitudinal direction of the groove 2 of the oval shape. FIG. 12D illustrates a state in which a certain period of time has further passed after the state of FIG. 12C. Thus, even when the ink has overshot the ejection port, the existence of the groove 2 can suppress the overflow of the ink to the periphery of the groove 2. In the present embodiment, even though a head had a high refilling frequency of approximately 40 kHz, the overshooting of the meniscus of the ink could be suppressed when the ink was refilled, and the overflow of the ink from the groove 2 could be suppressed. The liquid ejecting head could stably print characters by 1 pass continuously at high speed, even when the ink jet recording apparatus performed a scan at a driving frequency of 30 kHz and at a carriage speed of 50 inches/second.

Figure 13:
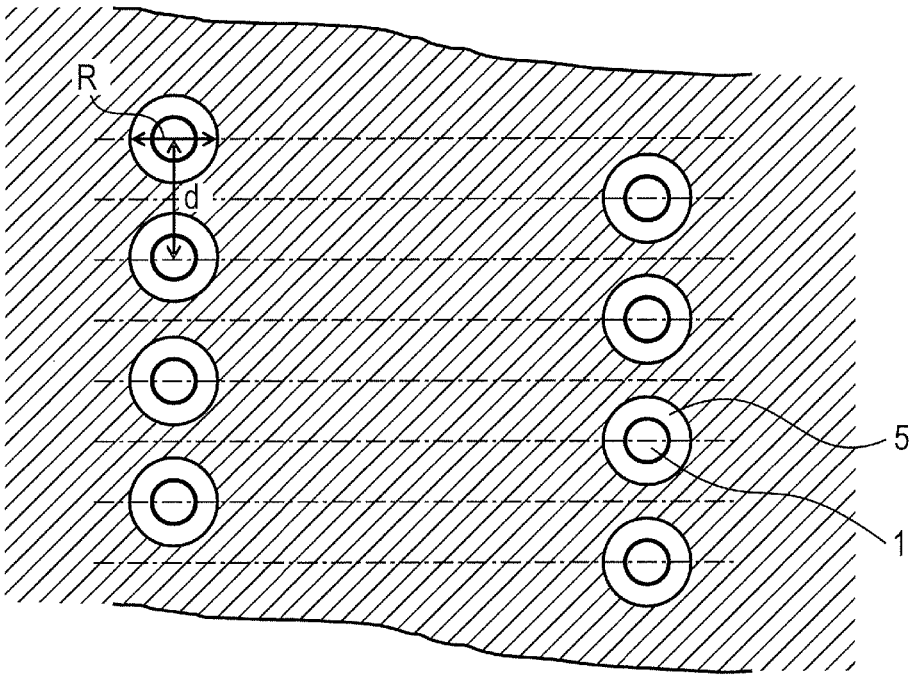
FIG. 13 is a schematic view of a recording head as a Comparative Example of the present invention.
Figure 14:
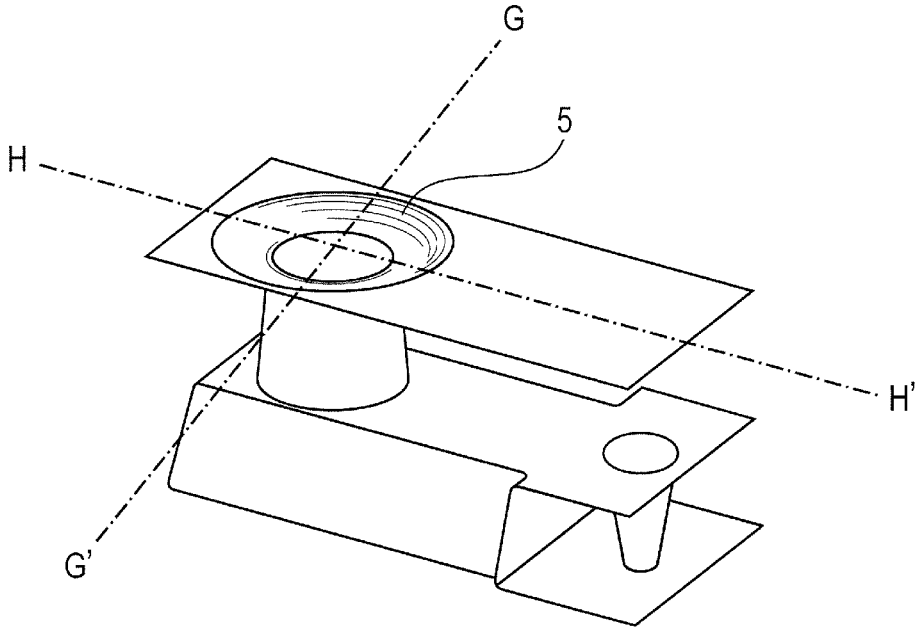
FIG. 14 is a perspective view of an appearance of a nozzle of the recording head as the Comparative Example of the present invention.

FIG. 13 to FIG. 16D are schematic views for describing Comparative Example of the present invention. In addition, FIG. 14 is a perspective view of an appearance of a recording head, and a liquid ejecting head is provided with a recessed portion 5 in place of the groove 2 described in each of the above embodiments.

A plurality of recessed portions 5 which are formed so as to be more recessed than a diagonally shaded area are formed on an orifice plate in FIG. 13, and one ejection port 1 is provided on the inside of each of the recessed portions 5.

FIG. 14 illustrates a view of an appearance of a nozzle. The ejection port 1 (FIG. 13) is formed in the circle-shaped recessed portion 5.

Figure 15A:
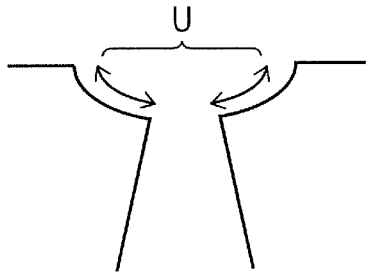
FIG. 15A is a view of a cross section taken along the line G-G' of FIG. 14.
Figure 15B:
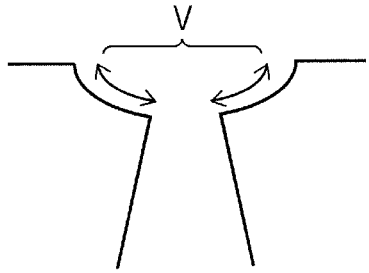
FIG. 15B is a view of a cross section taken along the line H-H' of FIG. 14.

FIG. 15A is a view of a cross section taken along the line G-G' of FIG. 14. The maximum depth of the recessed portion 5 is 2 μm, and a diameter thereof is 35 μm. FIG. 15B is a view of a cross section taken along the line H-H' of FIG. 14, and the diameter of the recessed portion is similarly 35 μm. An average value of a curvature in a full width of the recessed portion except the ejection port in the cross section taken along the line G-G' is approximately equal to an average value of a curvature in a full width of the recessed portion except the ejection port in the cross section taken along the line H-H'. In FIGS. 15A and 15B, a region in the cross section taken along the line G-G', for which the average value of the curvature is calculated, is described as U, and a region in the cross section taken along the line H-H', for which the average value of the curvature is calculated, is described as V.

Figure 16A:
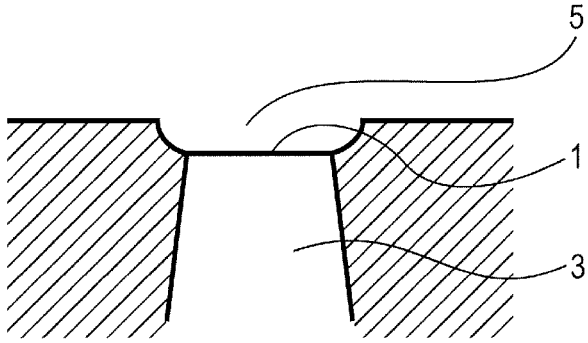
FIGS. 16A, 16B, 16C and 16D are schematic views illustrating states of the ink in time series, which is refilled in the recording head as the Comparative Example of the present invention.
Figure 16B:
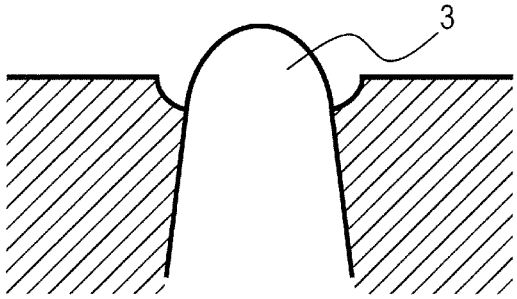

FIGS. 16A, 16B, 16C and 16D are schematic views illustrating a process of refilling the ejection port with an ink after the ink droplet has been ejected, in time series, in the circle-shaped recessed portion 5. In these FIGS. 16A to 16D, the ejection port 1, the ink 3 and the recessed portion 5 are each shown. FIG. 16A illustrates a state of the time before the ink is ejected, and FIG. 16B illustrates a state in which the ejection port is refilled with an ink after the ink has been ejected, and the ink overshoots the ejection port to hump to the maximum height. The height of the hump was approximately 8 μm.

Figure 16C:
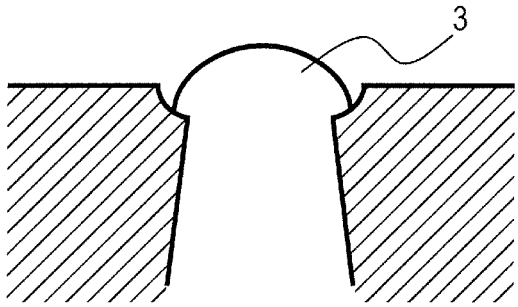
Figure 16D:
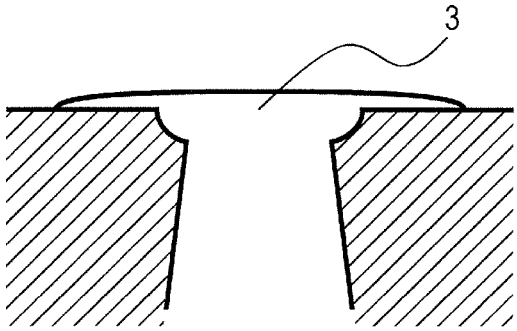

FIG. 16C illustrates a state in which a certain period of time has further passed after the state in which the ink has humped to the maximum height. The ink having humped equally spreads symmetrically in every direction so as to form a circle. FIG. 16D illustrates a state in which a certain period of time has further passed after the state of FIG. 16C. The ink results in climbing over the recessed portion and the overflow of the ink occurs. The overflow of the ink results in reaching the adjacent nozzle, though the overflow is not shown.

With respect to a head having a high refilling frequency of approximately 40 kHz, in the above described liquid ejecting head which belongs to the Comparative Example of the present invention, the meniscus of the ink resulted in overshooting in this way when the ejection port was refilled with the ink, and the ink resulted in overflowing from the periphery of the ejection port. When the ink jet recording apparatus performed a scan at a driving frequency of 30 kHz and at a carriage speed of 50 inches/second, a printing kink resulted in being formed. The head having the circle-shaped recessed portion could not stably print characters by 1 pass continuously at high speed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-094800, filed Apr. 18, 2012, which is hereby incorporated by reference herein in its entirety.

What is claimed is:

1. A liquid ejecting head comprising:

an orifice plate provided with an ejection port forming face which has an ejection port row formed thereon, the ejection port row including a plurality of ejection ports which eject a liquid and are arrayed in a first direction; and a plurality of grooves provided on the ejection port forming face, the plurality of grooves having a length in a second direction that intersects with the first direction, which length is greater than a width of the grooves in the first direction, wherein the ejection ports are formed inside the plurality of grooves, and with respect to a cross-section of the grooves in the first direction, which includes centers of the ejection ports, the grooves have an inner wall surface in a circular arc shape, and the grooves have an aperture which is larger than an aperture of the ejection ports, in the first direction.

2. The liquid ejecting head according to claim 1, wherein with respect to a cross-section of the grooves in the second direction, which includes centers of the ejection ports, the grooves each have a flat bottom face except at the ejection port.

3. The liquid ejecting head according to claim 1, wherein the plurality of the grooves do not communicate with each other.

4. The liquid ejecting head according to claim 1, wherein the plurality of the grooves are formed in parallel.

5. The liquid ejecting head according to claim 1, wherein with respect to a cross-section of the grooves in the first direction, which does not include the ejection ports, the grooves each have an inner wall surface in a circular arc shape.

6. The liquid ejecting head according to claim 1, wherein a second ejection port row is formed on the ejection port forming face along the ejection port row, and the ejection ports included in the ejection port row and ejection ports included in the second ejection port row are both formed in one of each of the grooves.

7. The liquid ejecting head according to claim 1, wherein a second ejection port row is formed on the ejection port forming face along the ejection port row, and the ejection ports included in the ejection port row and ejection ports included in the second ejection port row are formed in different grooves, respectively.

8. The liquid ejecting head according to claim 1, wherein with respect to a cross-section of the grooves in the second direction, which includes centers of the ejection ports, the grooves each have an inner wall surface in a circular arc shape, and the grooves each have a curvature of the circular arc shape in the cross-section in the first direction which is larger than a curvature of the circular arc shape in the cross-section in the second direction.

9. The liquid ejecting head according to claim 1, wherein two or more of the plurality of ejection ports are disposed inside one of the grooves.

10. A liquid ejecting head comprising:

an orifice plate provided with an ejection port forming face which has an ejection port row formed thereon, the ejection port row including a plurality of ejection ports which eject a liquid and are arrayed in a first direction, wherein the ejection ports are each formed inside one of a plurality of grooves which are provided on the ejection port forming face and extend in a second direction that intersects with the first direction, with respect to a cross-section of the grooves in the first direction, which includes centers of the ejection ports, the grooves each have an inner wall surface of an inclined plane, and the grooves each have an aperture which is larger than an aperture of the ejection ports, in the first direction.

11. The liquid ejecting head according to claim 10, wherein with respect to a cross-section of the grooves in the first direction, which does not include the ejection ports, the grooves each have an inner wall surface in a V-shape.

12. A liquid ejecting head comprising:

an orifice plate provided with an ejection port forming face which has an ejection port row formed thereon, the ejection port row including a plurality of ejection ports which eject a liquid and are arrayed in a first direction; and a plurality of grooves provided on the ejection port forming face, the plurality of grooves having a length in a second direction that intersects with the first direction, which length is greater than a width of the grooves in the first direction, wherein the ejection ports are formed inside the plurality of grooves.

* * * * *